US010098414B2

(12) United States Patent
Cavanagh et al.

(10) Patent No.: US 10,098,414 B2
(45) Date of Patent: Oct. 16, 2018

(54) FOOTWEAR SYSTEM WITH COMPOSITE ORTHOSIS

(71) Applicants: DIAPEDIA, LLC, State College, PA (US); University of Delaware, Newark, DE (US)

(72) Inventors: Peter R. Cavanagh, Seattle, WA (US); Timothy B. Hurley, Boalsburg, PA (US); John J. Tierney, Newark, DE (US); John W. Gillespie, Jr., Hockessin, DE (US)

(73) Assignees: DIAPEDIA, LLC, State College, PA (US); UNIVERSITY OF DELAWARE, Newark, DE (US)

( * ) Notice: Subject to any disclaimer, the term of this patent is extended or adjusted under 35 U.S.C. 154(b) by 446 days.

(21) Appl. No.: 14/199,790

(22) Filed: Mar. 6, 2014

(65) Prior Publication Data

US 2014/0298682 A1 Oct. 9, 2014

Related U.S. Application Data

(60) Provisional application No. 61/773,479, filed on Mar. 6, 2013.

(51) Int. Cl.

| | |
|---|---|
| ***A43B 13/38*** | (2006.01) |
| ***A43B 13/18*** | (2006.01) |
| ***A43B 7/14*** | (2006.01) |
| ***A43B 13/02*** | (2006.01) |
| ***A43B 13/12*** | (2006.01) |
| ***A43B 13/14*** | (2006.01) |

(52) U.S. Cl.

CPC ..... *A43B 13/386* (2013.01); *A43B 7/141* (2013.01); *A43B 7/1445* (2013.01); *A43B 13/026* (2013.01); *A43B 13/127* (2013.01); *A43B 13/141* (2013.01); *A43B 13/181* (2013.01); *A43B 13/183* (2013.01)

(58) Field of Classification Search

CPC ..... A43B 13/181; A43B 13/183
USPC ..... 36/27, 7.8, 35 R
See application file for complete search history.

(56) References Cited

U.S. PATENT DOCUMENTS

| | | | | |
|---|---|---|---|---|
| 4,133,086 | A | 1/1979 | Brennan | |
| 4,196,903 | A | 4/1980 | Illustrato | |
| 4,562,651 | A | 1/1986 | Frederick et al. | |
| 4,590,123 | A | 5/1986 | Hashimoto et al. | |
| 4,912,859 | A | 4/1990 | Ritts | |
| 4,936,030 | A | 6/1990 | Rennex | |
| 5,052,130 | A * | 10/1991 | Barry | A43B 5/049 36/107 |
| 5,343,637 | A | 9/1994 | Schindler | |

(Continued)

*Primary Examiner* — Ted Kavanaugh

(57) ABSTRACT

The improved footwear system of the present application uses composite materials in the design of an advanced modular in-shoe foot orthosis and a new container assembly which includes a high performance energy storage and return element orthosis. The footwear system uses a method of manufacture incorporating a new last model. The advantages of the footwear system over standard issue combat boots include lower weight, improved treatment of lower extremity overuse injuries and reduction of the occurrence of such overuse injuries by protecting at-risk feet with advanced footwear which can be customized to meet the biomechanical needs as well as the specific activities of the wearer.

8 Claims, 21 Drawing Sheets
(18 of 21 Drawing Sheet(s) Filed in Color)

(56) References Cited

U.S. PATENT DOCUMENTS

| | | | | |
|---|---|---|---|---|
| 5,343,639 | A | 9/1994 | Kilgore et al. | |
| 5,367,790 | A * | 11/1994 | Gamow | A43B 5/06 36/27 |
| 5,435,079 | A | 7/1995 | Gallegos | |
| 5,469,638 | A | 11/1995 | Crawford, III | |
| 5,517,769 | A | 5/1996 | Zhao | |
| 5,528,842 | A | 6/1996 | Ricci et al. | |
| 5,701,686 | A * | 12/1997 | Herr | A43B 5/06 36/27 |
| 6,029,374 | A | 9/2000 | Herr et al. | |
| 6,115,942 | A | 9/2000 | Paradis | |
| 6,282,814 | B1 | 9/2001 | Krafsur et al. | |
| 6,516,540 | B2 | 2/2003 | Seydel et al. | |
| 6,589,630 | B1 | 7/2003 | Crow | |
| 6,684,531 | B2 | 2/2004 | Rennex | |
| 6,719,671 | B1 | 4/2004 | Böck | |
| 6,964,119 | B2 | 11/2005 | Weaver, III | |
| 7,062,865 | B1 | 6/2006 | Nordt, III | |
| 7,159,339 | B2 * | 1/2007 | Mathieu | A43B 3/0036 36/3 B |
| 7,219,447 | B2 | 5/2007 | Levert et al. | |
| 7,219,449 | B1 | 5/2007 | Hoffberg et al. | |
| 7,395,614 | B1 | 7/2008 | Bailey, Sr. et al. | |
| 7,832,118 | B2 | 11/2010 | Holden et al. | |
| 8,234,798 | B2 | 8/2012 | Dibenedetto et al. | |
| 8,438,757 | B2 | 5/2013 | Roser | |
| 8,528,233 | B2 | 9/2013 | Killion | |
| 8,627,582 | B2 | 1/2014 | Perenich | |
| 8,732,983 | B2 | 5/2014 | Goldston et al. | |
| 8,959,797 | B2 * | 2/2015 | Lyden | A43B 1/0081 36/27 |
| 2003/0056396 | A1 | 3/2003 | Murray et al. | |
| 2003/0069807 | A1 * | 4/2003 | Lyden | A43B 1/0081 705/26.5 |
| 2004/0177531 | A1 | 9/2004 | Dibenedetto et al. | |
| 2010/0324455 | A1 | 12/2010 | Rangel et al. | |
| 2011/0185591 | A1 | 8/2011 | Actis et al. | |

* cited by examiner

Key: 1) Outsole 2) Container 3) Energy storage and return orthosis 4) Midsole 5) In-shoe foot orthosis – base 6) In-shoe foot orthosis – laminate top 7) Liner 8) Toe cap 9-10) Boot armor 11) Upper Figure 15a
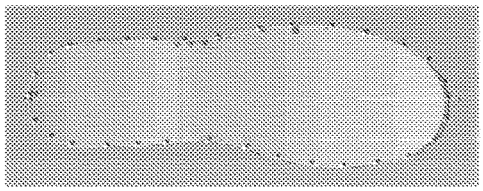
Figure 15b
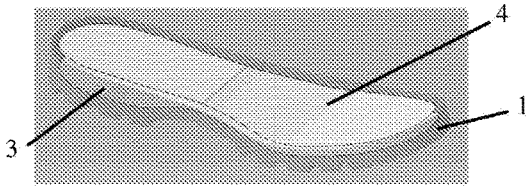
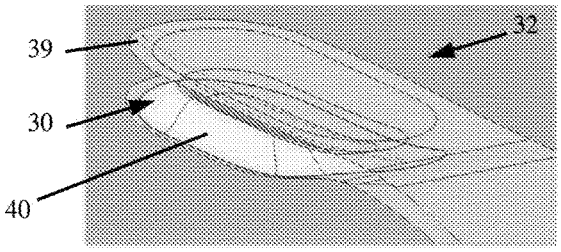
Figure 15c
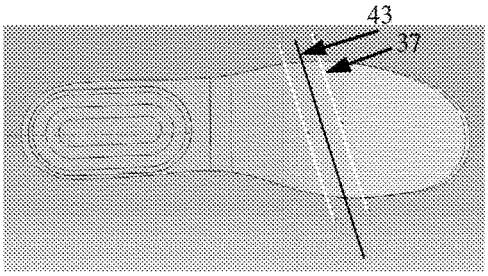
Figure 15d

| Ply Count | thickness (0.008 per ply) | Thickness (mm) | Applied Force (lb) | Energy (J) | Displacement (in) |
|---|---|---|---|---|---|
| 4 | 0.032 | 0.813 | 200 | 1.83 | 0.24 |
| 5 | 0.040 | 1.016 | 200 | 1.07 | 0.14 |
| 5 | 0.040 | 1.016 | 325 | 2.83 | 0.23 |
| 6 | 0.048 | 1.219 | 325 | 1.87 | 0.15 |
| 6 | 0.048 | 1.219 | 485 | 4.08 | 0.24 |
| 7 | 0.056 | 1.422 | 485 | 2.95 | 0.16 |
| 7 | 0.056 | 1.422 | 665 | 5.55 | 0.22 |
| 8 | 0.064 | 1.626 | 665 | 4.12 | 0.17 |
| 8 | 0.064 | 1.626 | 900 | 7.55 | 0.22 |

Figure 17a
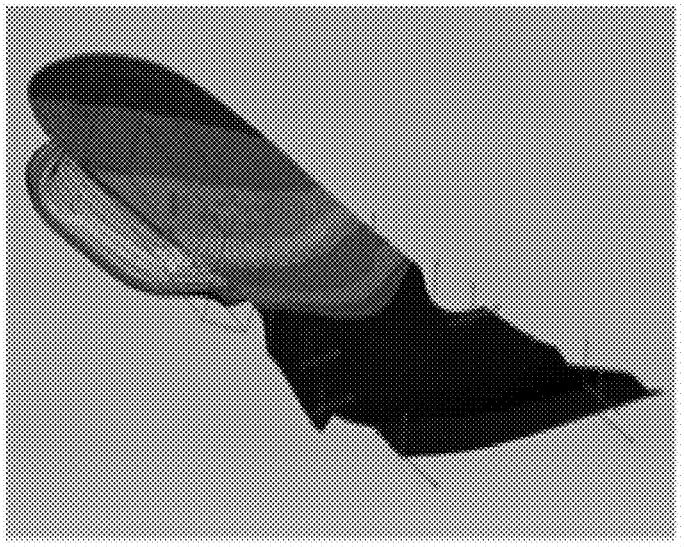
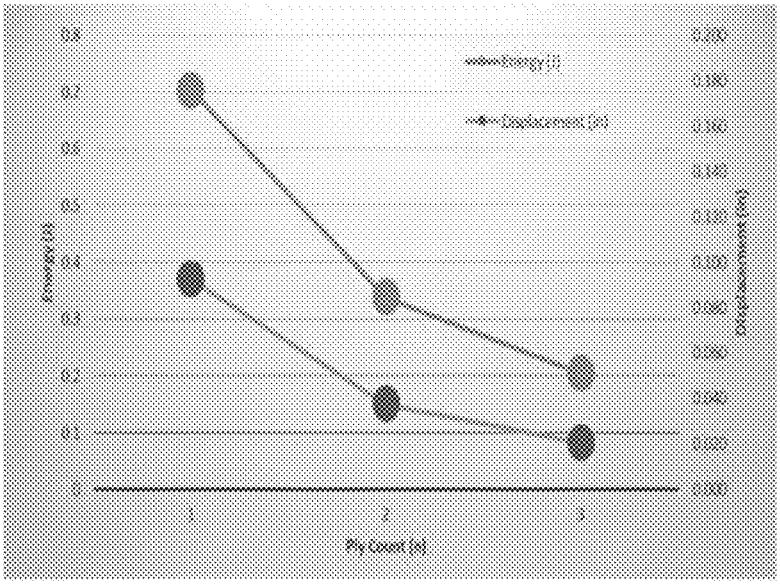
Figure 17b

Figure 20a
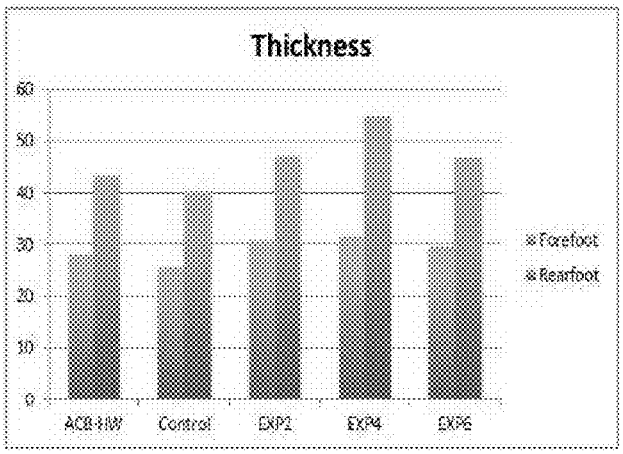
Figure 20b
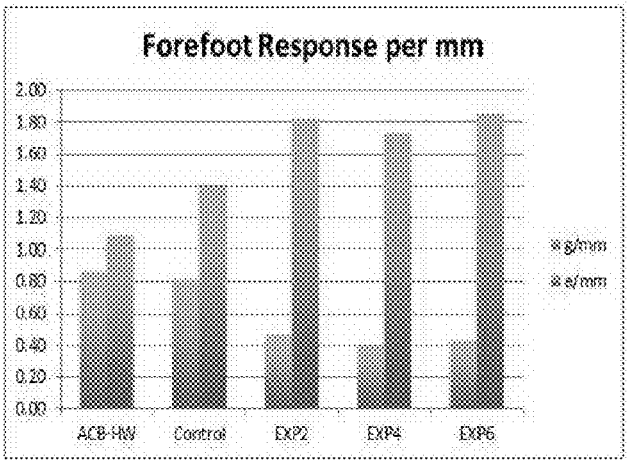
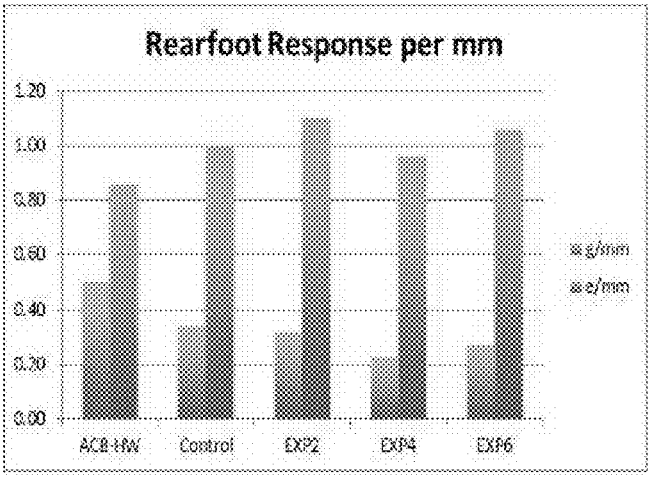
Figure 20c

Figure 24a
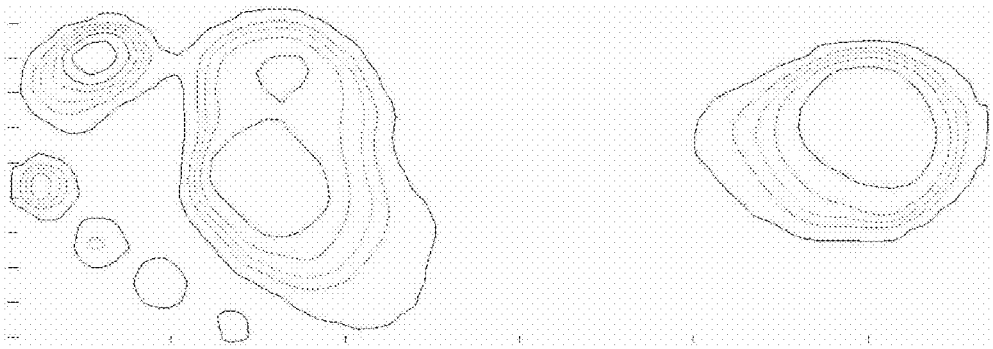
Figure 24b
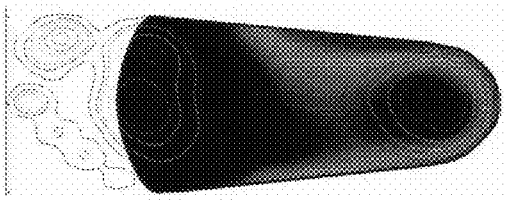
Figure 24c
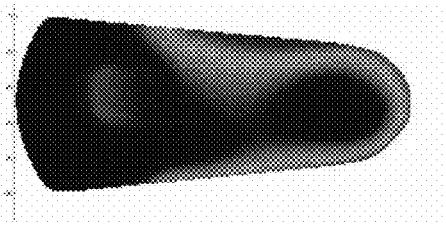
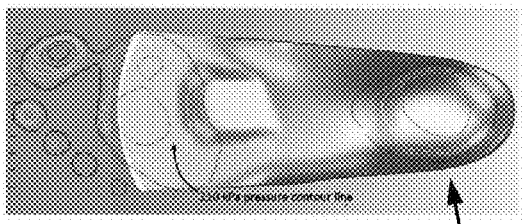
Figure 24d
21
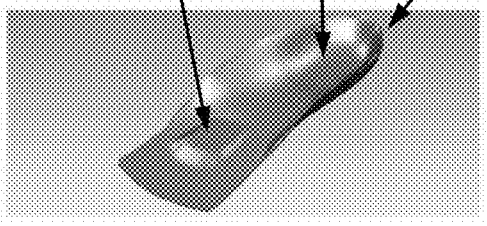
Figure 24e

FOOTWEAR SYSTEM WITH COMPOSITE ORTHOSIS

CROSS-REFERENCE TO RELATED APPLICATION

This application claims the benefit of U.S. Provisional Application No. 61/773,479, filed Mar. 6, 2013, the entirety of which is incorporated herein by reference.

STATEMENT REGARDING FEDERALLY SPONSORED DEVELOPMENT

The subject matter of this application was developed pursuant to a Small Business Innovation Research award from the U.S. Army, Contract No. W81XWH-12-C-0041. The government may have certain rights in the invention.

FIELD OF INVENTION

The present application provides an improved footwear system, and in particular to a footwear system which includes new elements such as a new customized in-boot or shoe foot orthosis and a new high performance composite energy storage and return orthosis.

BACKGROUND

Although footwear science has made considerable progress in the last decade, a performance gap continues to exist between standard issue military footwear and expedition footwear available on the commercial market. While the provision of in-shoe foot orthoses (ISFOs) is commonplace in commercial athletic and outdoor footwear, the provision of similar devices that can be accommodated in military footwear has not received significant attention. The high rates of lower extremity injuries in the military point to the urgent need to close the footwear performance gap by providing military personnel with footwear and in-boot orthoses that incorporate up-to-date biomechanical knowledge and state-of-the-art materials.

SUMMARY

The improved footwear system of the present application uses composite materials, footwear biomechanics, and military medicine to manufacture new military footwear in the design of an advanced customized in-shoe foot orthosis and a new boot footbed assembly which includes a high performance composite material energy storage and return element orthosis. The technology developed in this footwear is intended for adaptation and utilization by all active military personnel in all divisions who are issued standard military footwear. The advantages of the footwear system include treatment of lower extremity overuse injuries and reduction of the occurrence of such overuse injuries by protecting at-risk feet with advanced footwear which can be customized to meet the biomechanical needs of the individual, for example, redistribution of plantar pressures of the wearer and reduced metabolic energy cost by improved energy storage and return performance during ambulation.

The new footwear system was designed based upon a comprehensive assessment of current military footwear and related specifications, resulting in a new combat boot last model. The new footwear system maintains the existing performance requirements and also incorporates several features aimed at improving footwear performance for the active soldier, including: improved energy storage over prior art combat boots, improved energy return over prior art combat boots, and reduced weight in the individual components and overall weight of the footwear system as compared to prior art combat boots. The new footwear system was constructed based upon the geometry of a new combat boot Last model which is designed to accommodate a custom in-shoe foot orthosis. A last, as generally defined, includes a foot shaped form which is used to design and create each shoe's rearfoot width, instep height, toe box width and toe box depth. A last is used by shoemakers in the manufacture of footwear.

A parameterized finite element model was developed so that certain key elements of the new energy return and storage orthosis could be specified and, therefore, easily changed to facilitate a parametric approach to the energy return and storage orthosis design. A predetermined set of design parameters was established to separately characterize forefoot and rearfoot function of the energy return and storage orthosis (ERSO). The fully parameterized finite element model was employed to conduct forefoot and rearfoot ply count studies. The results of these studies were used to guide the construction of ESRO prototypes for impact testing. The finite element model for the ESRO may also be employed to tailor the ESRO properties to provide optimal energy storage and return performance based upon a physical characteristic unique to the individual (e.g., body weight or foot arch type) or based upon a specific activity (e.g., physical training, long-march infantry, paratrooping or heavy load carriage).

The design of a base component for the in-shoe foot orthosis of the new footwear system included evaluation of surface modifications based upon the three-dimensional shape of the wearer's foot and plantar pressure distribution. As with the ESRO, the level of ISFO customization can be tailored to the biomechanical requirement of the individual wearer and/or to the planned physical activity to optimize comfort, support and performance of the new footwear system.

DESCRIPTION OF THE DRAWINGS

This patent or application file contains at least one drawing executed in color. Copies of this patent or patent application publication with color drawing(s) will be provided by the Office upon request and payment of the necessary fee.

FIG. 14*b* is a graphical illustration of the computer simulation results where the rearfoot of the ESRO is under constant pressure stress.

FIG. 14*c* is a graphical illustration of the computer simulation results where the composite ESRO forefoot is under lift stress with 2 lbs. of rearfoot force.

FIG. 14*d* is a graphical illustration of the computer simulation results showing the stresses in the 1st (0) ply of the modeled ESRO.

FIGS. 15*a* to 15*d* are graphic illustrations of the ESRO finite element modeling design parameters, where FIG. 15*a* specifically illustrates the new Last model bottom profile parameter.

FIG. 15*b* is a graphical illustration of the ESRO finite element modeling design parameter for the container of the footwear system showing the volume of the container including the ESRO.

FIG. 15*c* is a graphical illustration of the ESRO finite element modeling design parameter for the rearfoot spring curves of the rearfoot section of the ESRO.

FIG. 15*d* is a graphical illustration of the ESRO finite element modeling design parameter for the forefoot metatarsophalangeal joint (MTPJ) axis of the ESRO.

FIG. 16*b* is a graphical illustration of the relationship between the applied force on the ESRO forefoot, the ply count of the ESRO tested and the resulting energy from the ESRO tested.

FIG. 16*c* is a graphical illustration of the results obtained from the ESRO forefoot ply testing.

FIGS. 17*a* to 17*b* are graphic illustrations of the ESRO finite element modeling results of the ply thickness considerations for the rearfoot section, where FIG. 17*a* specifically shows the computer simulation results of the translational displacement magnitude under stress.

FIG. 17*b* is a graphical illustration of the relationship between the applied force on the ESRO rearfoot section, the ply count of the ESRO tested and the resulting energy from the ESRO tested.

FIG. 20*a* is a graphical illustration of the impact response and return performance of the ESRO tested, which is normalized for the footbed thickness parameter.

FIG. 20*b* is a graphical illustration of the impact response and return performance of the forefoot responses of the ESRO tested.

FIG. 20*c* is a graphical illustration of the impact response and return performance of the rearfoot responses of the ESRO tested.

FIGS. 24*a* to 24*e* are partial graphic illustrations showing steps in the computer aided design process for development of the customized in-shoe foot orthosis, where FIG. 24*a* graphically illustrates a contour plot of the average peak plantar pressure for a wearer of the footwear system.

FIG. 24*b* is a graphical illustration of the computer software customization of the base orthosis shape and plantar pressure overlay of the in-shoe foot orthosis.

FIG. 24*c* is a graphical illustration of the computer software customization of the metatarsal pad position within the base orthosis of the in-shoe foot orthosis.

FIG. 24*d* is a graphical illustration of the computer software customization for positioning of the custom metatarsal pad within the base orthosis of the in-shoe foot orthosis showing the plantar pressure overall and using a specified plantar pressure contour line.

FIG. 24*e* is a graphical illustration of the customized base of the in-shoe foot orthosis with a patient specific metatarsal pad.

DETAILED DESCRIPTION

Figure 1:
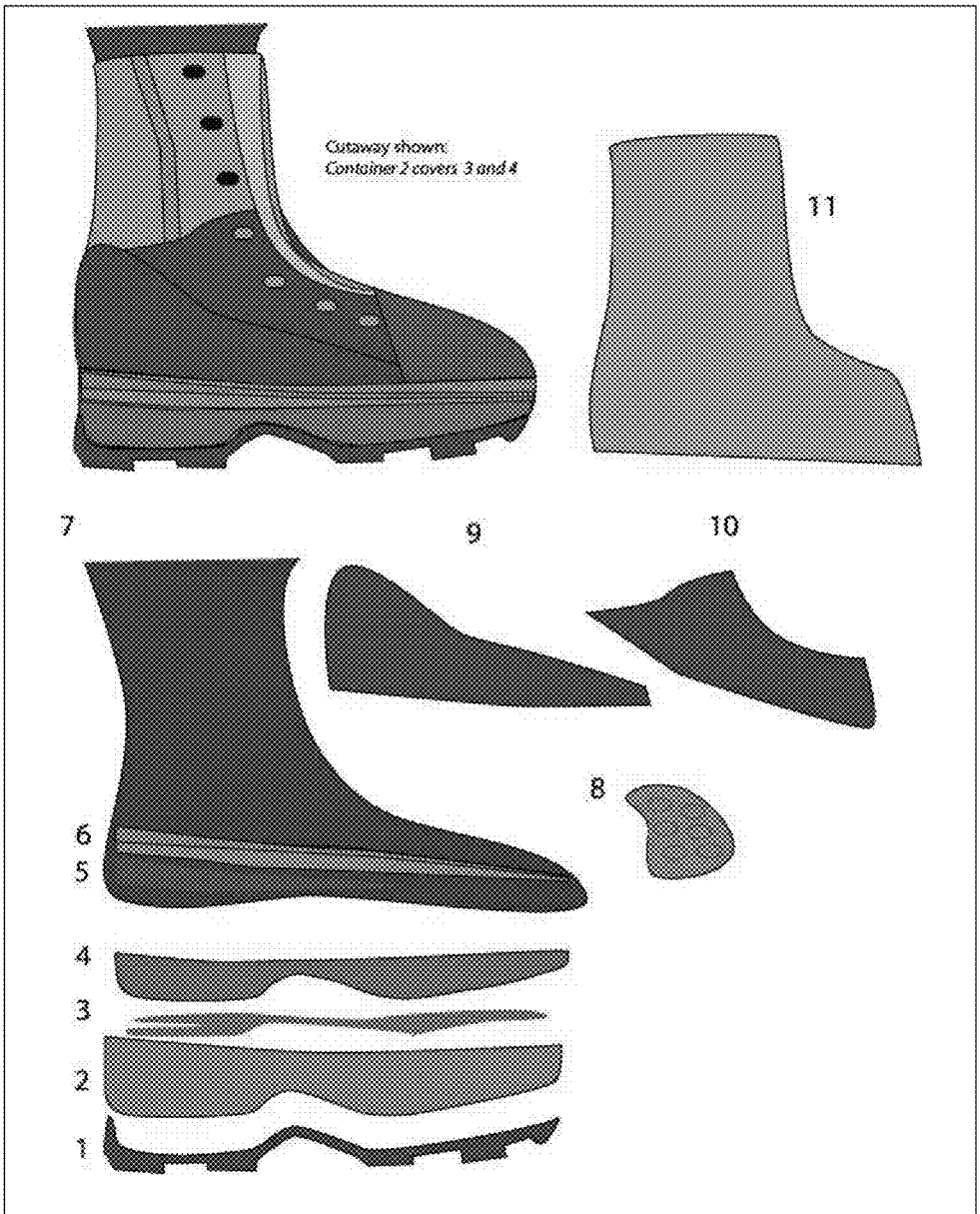
FIG. 1 schematically illustrates exploded components and descriptions of elements of the improved footwear system.

The present application provides an improved footwear system 20, shown schematically as an exploded view in FIG. 1, including an advanced customized in-shoe foot orthosis 21 and a new boot container 2 which includes a high performance composite energy storage and return element orthosis 3 The composite device utilizes both carbon and glass fiber based polymer materials that are optimized in layup, thickness and fiber orientation to maximize energy return. Referring in detail to FIG. 1, the improved footwear system 20 includes a footbed assembly 22 having a container 2 into which a composite energy storage and return orthosis 3 and cushioning midsole 4 are positioned.

Figure 6:
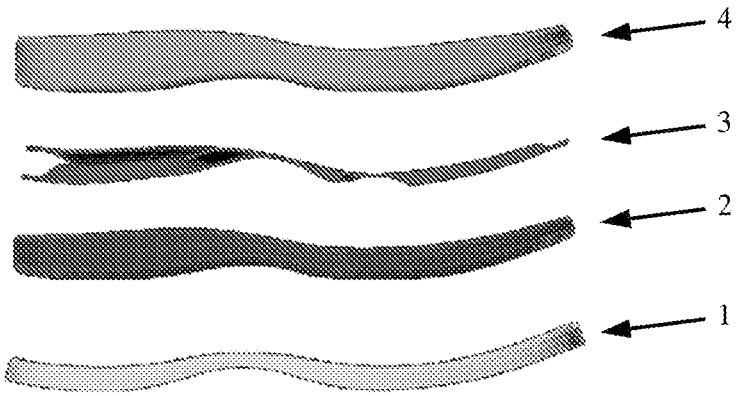
FIG. 6 illustrates an exploded view of the footbed assembly components of the new footwear system.

The container 2, which can be a separate component, or combined with an outsole 1 having a desired tread pattern, provides the durability required for boot-ground interaction. The dimensions of the container 2 are sufficient to allow the ESRO 3 and midsole 4 components to operate within the container volume. FIG. 6 further illustrates the relative position of the footbed assembly 22 components. The container is typically manufactured from standard footwear soling materials used for boot outsoles. In a preferred embodiment, the container 2 is produced using an injection molding process.

The midsole 4 provides a cushioning layer between the ESRO 3 and the upper portion of the footbed assembly 22. In a preferred embodiment, the midsole 4 is molded from standard materials, such as ethylene vinyl acetate foam or polyether polyurethane foam, to conform to the surface of the ESRO.

The base element of the advanced customized in-shoe foot orthosis 21, where the base is shown at reference 5 in FIG. 1, provides support for the medial column of the foot, or arch support. The base element of the ISFO 21 can be customized to the unique three dimensional foot shape of the wearer. Additional customization of the ISFO 21 can be achieved through placement of surface modifications (e.g., metatarsal pads and reliefs) based upon the unique plantar pressure distribution of the wearer.

Figure 2:
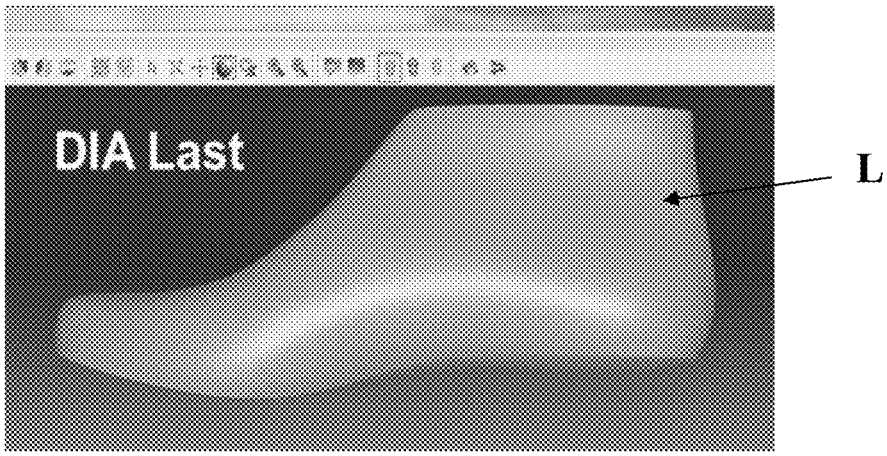
FIG. 2 illustrates a side view of the new combat boot Last model.
Figure 3:
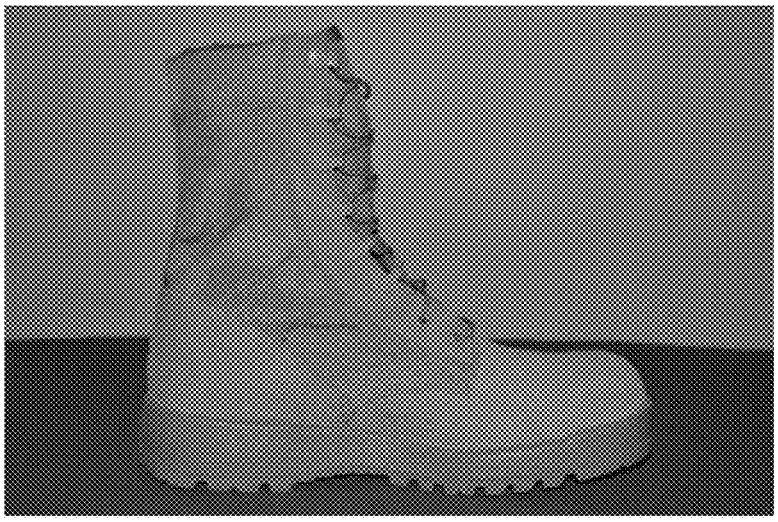
PRIOR ART Figure 3
FIG. 3 illustrates a prior art standard issue Army Combat Boot—Hot Weather.

The New Last Model The basis for the overall geometry and volume of the new footwear system is a new combat boot Last model, sometimes referenced as the DIA Last. As illustrated in FIG. 2, the new Last model L includes specific features designed for the active soldier. As set forth in Table 1, the footwear system has been designed to include improved features over and above those previously provided by the prior art Last model FMT U3813-1 (the "3813 Last"), which is identified in current military specification MIL-DTL-32237A, for the current standard issue Army Combat Boot—Hot Weather (ACB—HW), shown in FIG. 3. One of ordinary skill in the art of footwear manufacture will readily understand that the "last" is the physical form that the shoe/boot is made over. Generally, the last is inverted and an insole board is placed over the last and trimmed. Next, the upper material is drawn over the last and tacked to the insole board. The footbed (generally referring to the outsole and midsole) is attached to the upper material either by cementing, stitching or direct molding. Once the assembly process is complete, the last is removed. Thus, the geometry of the last generally determines the volume inside the shoe/boot.

The new Last model geometry was evaluated and compared with the prior art 3813 Last model currently used for boot construction:

TABLE 1

New Last Model Features

| Feature | Description |
|---|---|
| Cone and rearfoot contour | Anatomical cone and rearfoot contour to reflect a gradual slope through the cone area (instep) into the toe area thereby adding volume to accommodate a custom ISFO. |
| Toe spring and length | Toe spring height and overall length increased compared to standard issue boot in order to provide additional room for toe extension during the push off phase of the gait cycle. |
| Rearfoot shape/ edge radius | To better help spread the forces under the rearfoot, increased radius of the feather edge of the Last to take on a more natural shape. |
| Cross-rocker dimension | In order to reduce the stress on the metatarsals and to increase the performance of the ESRO, lowered the cross rocker depth from approximately 9 mm to 3 mm. |

Figure 4A:
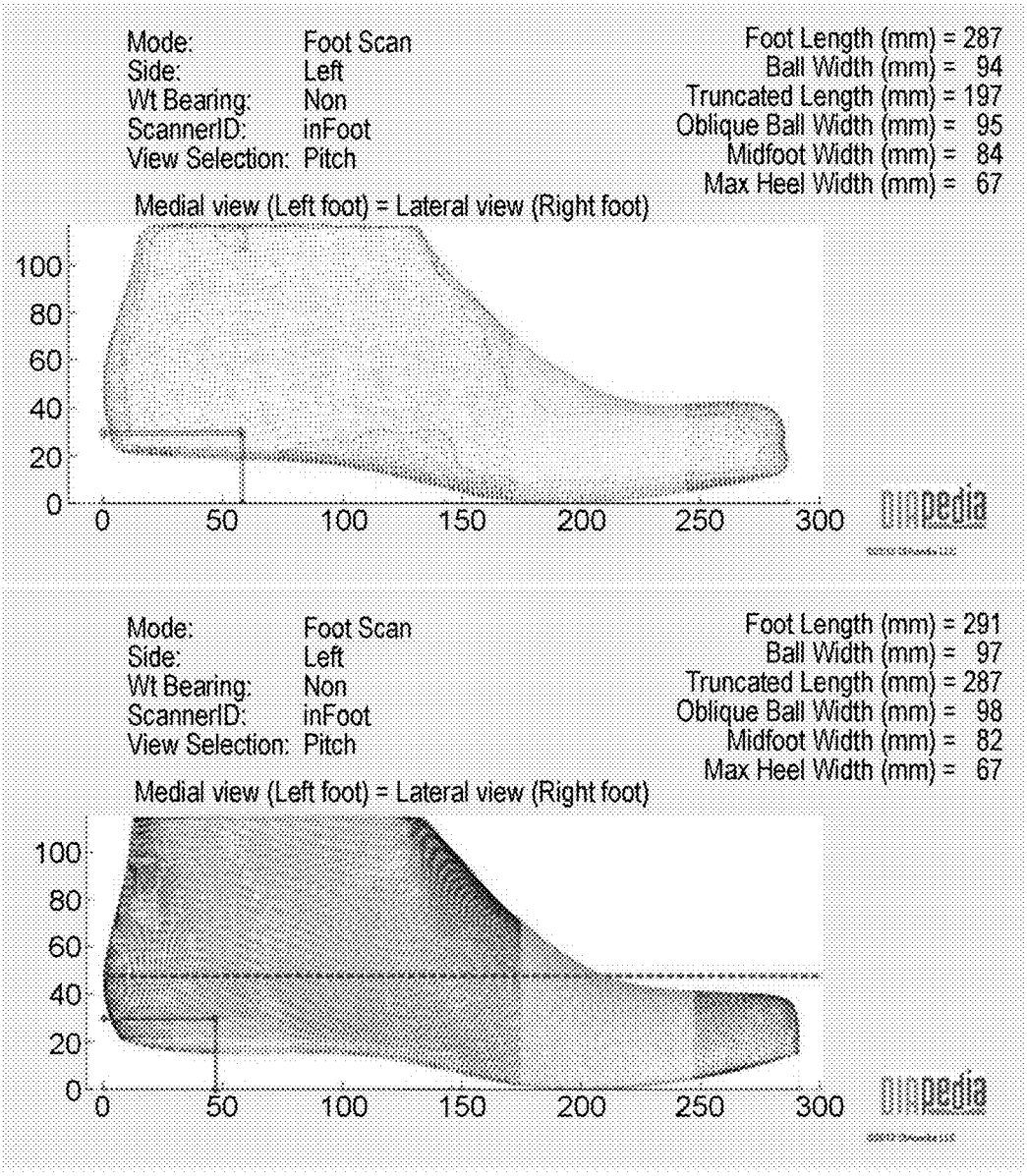
FIG. 4*a* illustrates a Point Cloud analysis comparing the dimensional measurements for the prior art Last model FMT U3813 for the standard issue Army Combat Boot—Hot Weather (left), with the new Last model of the improved footwear system (right).
Figure 4B:
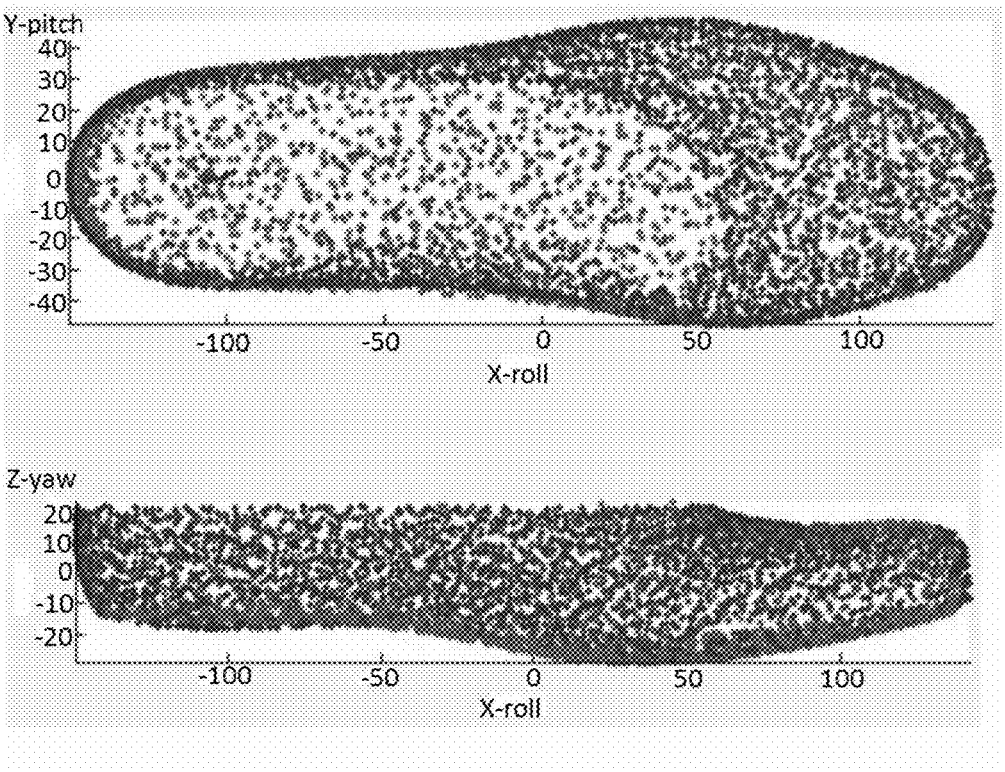
FIG. 4*b* illustrates a Point Cloud analysis comparing the dimensional measurements for the prior art Last model FMT U3813 for the standard issue Army Combat Boot—Hot Weather (red), with the new Last model of the improved footwear system (blue).

In addition, the new Last model was measured and compared with the prior art 3813 Last to confirm its improved features. As shown in FIGS. 4*a* and 4*b*, key dimensional measurements for the new Last model and the 3813 Last were compared using a proprietary Point Cloud analysis software program (PRC Point Cloud Analysis, DIApedia, LLC, State College, Pa.). As shown in FIGS. 4*a* and 4*b*, a three-dimensional data set is aligned on an x-y-z grid. Dimensions were then collected for the following foot measurements: foot length, ball width, truncated foot length, oblique ball width, midfoot width, and maximum rearfoot width. The Point Cloud analysis was conducted on Last models sized for a male size 9D foot. Results of the analysis, shown in Table 2, indicate that the new Last model, or DIA Last, is slightly longer and wider in the forefoot while similar in width in the midfoot and rearfoot compared to the 3813 Last. The modifications to the new Last model add volume and width to accommodate a slightly thicker (custom) insole.

TABLE 2

Dimensional comparison: FMT-U3813-1 Last and DIA Last model

| Measurement | 3813 Last | New Last model |
|---|---|---|
| Foot Length (mm) | 287 | 291 |
| Ball Width (mm) | 94 | 97 |
| Truncated Foot Length (mm) | 197 | 207 |
| Oblique Ball Width (mm) | 95 | 98 |
| Midfoot Width (mm) | 84 | 82 |
| Maximum Rearfoot Width (mm) | 67 | 67 |

Figure 5:
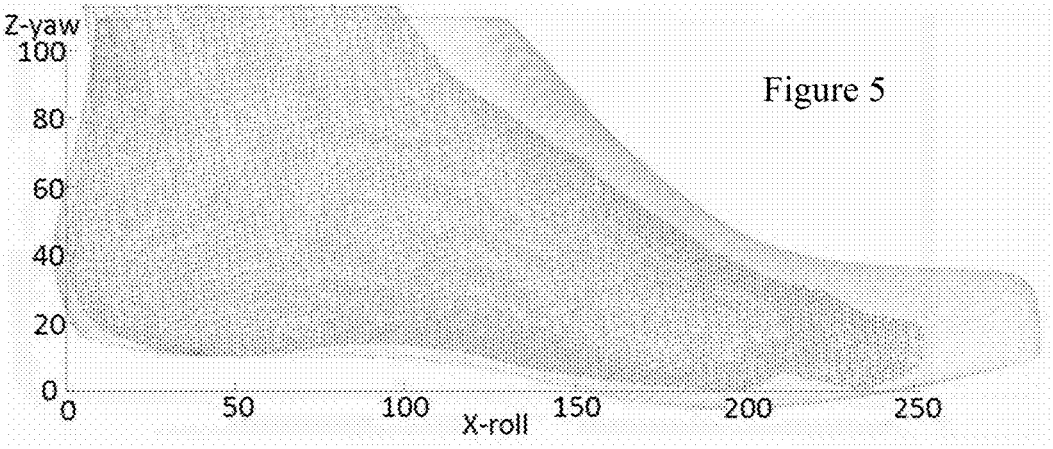
FIG. 5 illustrates an overlay of foot scan (male size 9D) with new Last model (or DIA Last) size 9D.

The new Last model internal volume was combined with three-dimensional foot shape data collected on Army personnel to create an overlay display, providing a visual assessment of the fit of the new Last model to a non-weight bearing foot, as shown in FIG. 5. Foot data was collected using the InFoot Scanner (available from I-ware Laboratory Co., Ltd., Japan). The overlay display clearly shows the increased volume in the toe box region, providing additional room during toe off in the active gait cycle and in the cone/dorsum area to accommodate a custom in-shoe foot orthosis 21.

The Energy Storage and Return Orthosis (ESRO) There is much discussion of energy return in the footwear literature—most of it from prosthetics and orthoses, where a complete replacement of the human foot offers significant opportunities for energy storage and return. (Segal et al (2011), Fey at al. (2011), Barr et al. (1992), Haffner et al. 2002). In the area of athletic shoes, while a number of individuals have speculated about the possibility of energy return (Stefanyshyn and Nigg 2000, Shorten 1993, Morgan et al. 1996, Nigg and Anton 1995, Cook et al. 1985) there have been no studies demonstrating reduced metabolic energy expenditure based on the return of strain energy alone. This may be because the emphasis of prior efforts has been on the rearfoot of the shoe. Based on the biomechanics of running, it is believed that significant energy return possibilities exist in the forefoot of the shoe, particularly with the composite material orthosis of the present application.

Thus, desired features for the advanced military combat footwear 20 of this application include reducing the internal load and increasing the energy return of the footbed assembly 22. Light-weight polymeric composite material systems, including, for example, carbon fiber laminates and/or fiberglass, are used in the present orthosis to achieve superior energy storage and return performance compared to traditional footwear designs using standard materials.

Figure 7:
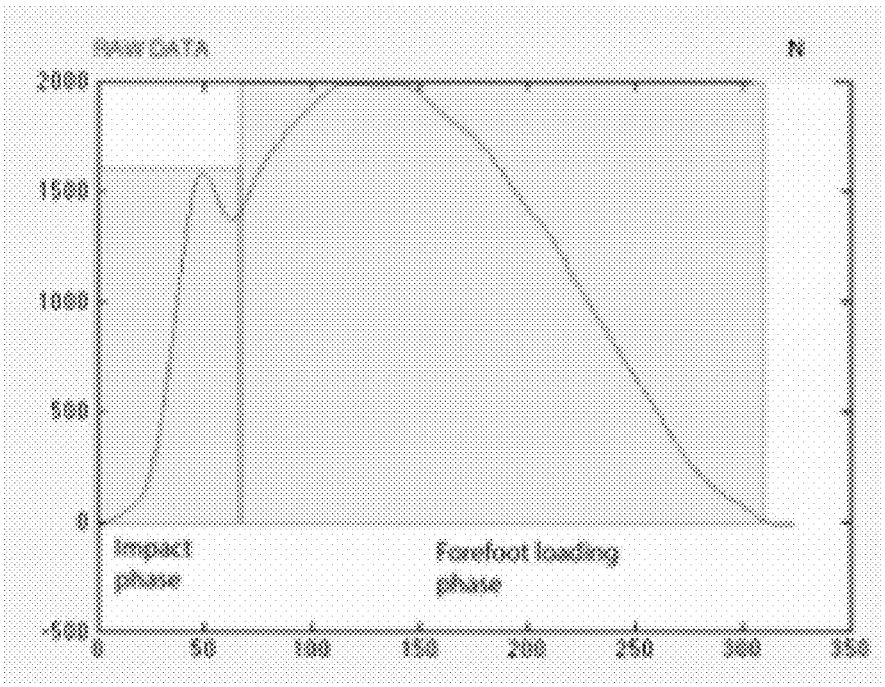
FIG. 7 is a graphic illustration of the Force (in Newtons) vs. Time (in ms) for a rearfoot strike running pattern.

ESRO Finite Element Model In order to maximize the energy storage and return potential of advanced composite materials, an understanding of the ground reaction forces experienced during running is required. FIG. 7 shows the contrasting force-time characteristics of the impact phase and propulsive phase of running in a rearfoot striker. The former is characterized by a brief high impact (peak at ~50 ms) which generally occurs in the rearfoot while the latter consists of a sustained loading of the forefoot (peak at ~125 ms) followed by a prolonged unloading phase. It is likely that, given this force-time relationship, energy can be recovered from a properly designed forefoot orthosis. For this reason, a finite element model (FEM) of the orthosis was developed so that loading and strain energy storage could be quantified.

Figure 8:
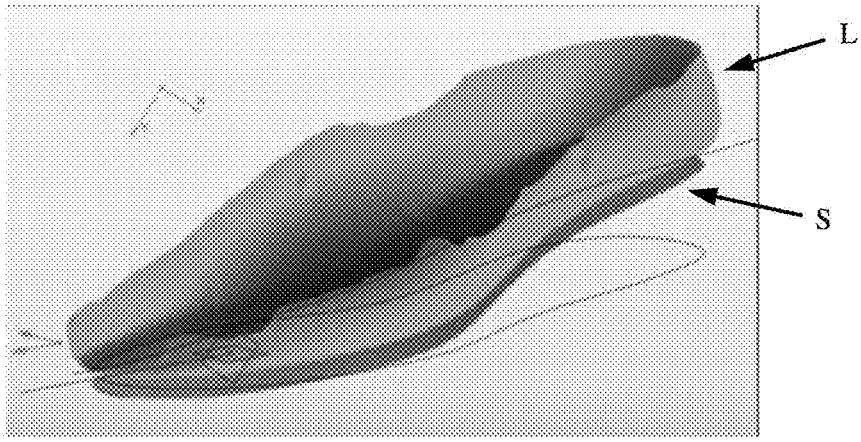
FIG. 8 illustrates an initial energy storage and return orthosis finite element model showing an extracted bottom surface of an outer shell geometry of the Last surface offset and contour cut.
Figure 9:
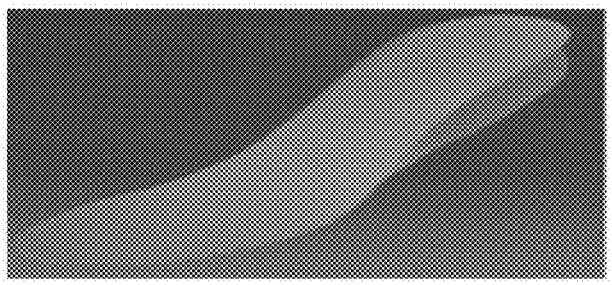
FIG. 9 illustrates the composite material energy storage and return orthosis of the improved footwear system.

The energy storage and return orthosis finite element model (FEM) makes use of an extracted bottom surface S of an outer shell geometry of the boot Last L, as shown in FIG. 8. This surface was used to develop a model of an ESRO with a continuous composite top surface, as shown in FIG. 9, to minimize stress concentrations and provide maximum coverage for penetration resistance. This design provides energy storage in the rearfoot location and was used in the finite element software program, CATIA (available from Dassault Systèmes, 175 Wyman Street, Waltham, Mass. 02451), to develop a design that also provided energy return in the forefoot location.

Figure 10A:
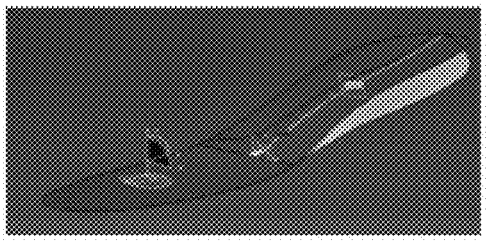
FIG. 10*a* illustrates the finite element composite laminate model for the energy storage and return orthosis of the improved footwear system.
Figure 10B:
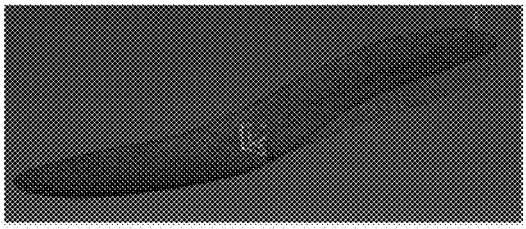
FIG. 10*b* illustrates the finite element mesh model of the orthosis of FIG. 10*a*.
Figure 11:
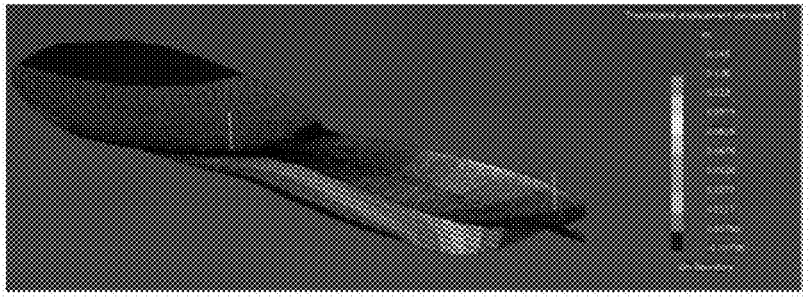
FIG. 11 illustrates the finite element analysis showing displacement results on the energy storage and return orthosis with 250 lbs applied at rearfoot location.

A CATIA computer aided design (CAD) shell model of the composite ESRO was developed to predict the overall stiffness of the structure based on the physical geometry, shown in FIG. 10*a*, and the associated mesh, shown in FIG. 10*b*. The composite module within CATIA was used to define zones on the surfaces that represent ply definition. In an initial model, a simple 4 ply [0/90/45/−45] carbon fiber laminate was assigned to the top and bottom of the spring and a load of 250 lbs. applied to the model over the entire rearfoot 32 area, which resulted in a displacement of 0.14 inches, as in shown in FIG. 11.

Figure 12A:
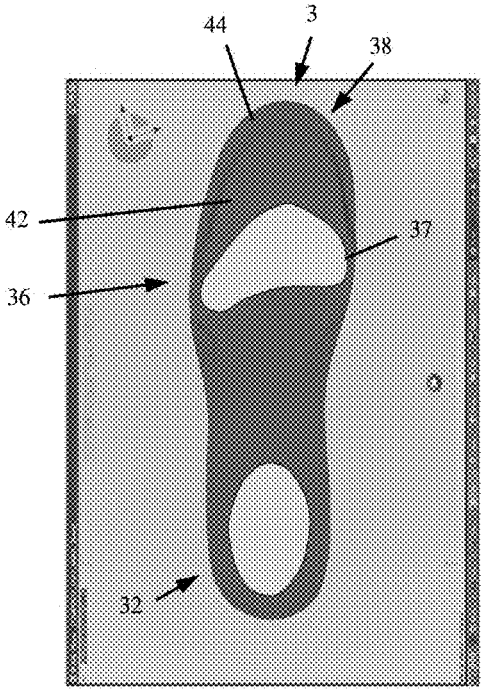
FIG. 12*a* illustrates the location of the forefoot and heel or rearfoot features in the energy storage and return orthosis insert.
Figure 12B:
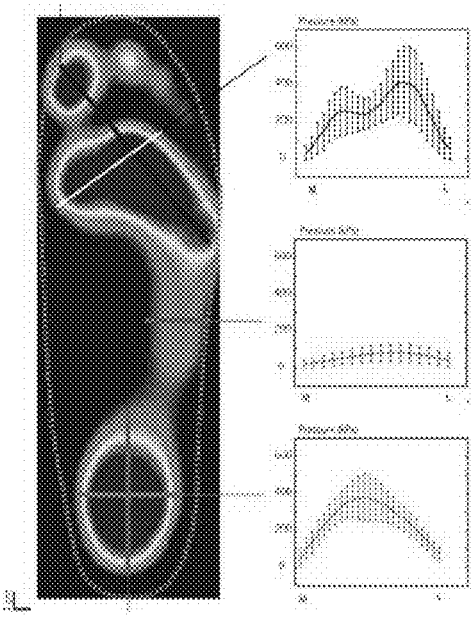
FIG. 12*b* graphically illustrates a plantar pressure data distribution, alongside the resulting orthosis in FIG. 12*a*, and a further individual graphical illustration of the pressure distributions under the foot in the locations indicated on the plantar pressure data distribution.
Figure 13A:
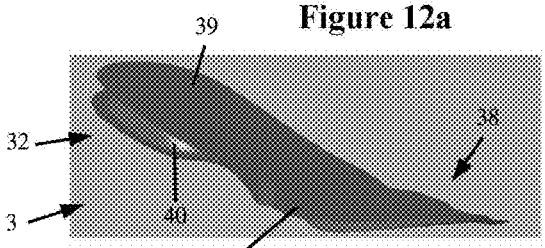
FIG. 13*a* illustrates an isometric view of the ESRO composite structure.
Figure 13B:
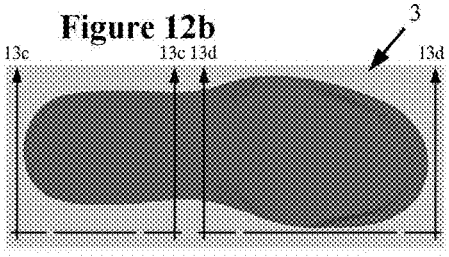
FIG. 13*b* illustrates a top view of the ESRO of FIG. 13*a*.
Figure 13C:
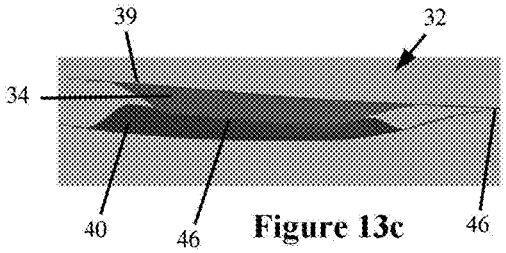
FIG. 13*c* illustrates a partial side view of the rearfoot spring area of the ESRO of FIG. 13*a*.
Figure 13D:
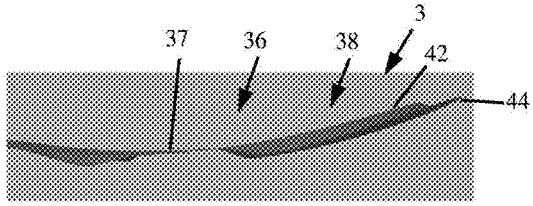
FIG. 13*d* illustrates a partial side view of the central bending compliance zone in the forefoot section of the ESRO of FIG. 13*a*.

The initial model was then improved for spring and comfort at the rearfoot 32 area and energy return in the forefoot 38 area. The locations of the rearfoot and forefoot landing features are based upon a typical foot plantar pressure distribution as shown in FIG. 12*a* on the ESRO from the plantar pressure distribution data shown in FIG. 12*b*. The improved energy storage and return orthosis 3 is shown in FIGS. 13*a-b* and is comprised of a spring element 40 in the rearfoot 32, and a spring element 36 at the forefoot 38 with built in compliance in bending within a compliance bending zone 37. The bending compliance zone 37 is located in the metatarsophalangeal joint (MTPJ) region of the forefoot 38, as shown in FIGS. 15*d*and 13*d*, along a metatarsophalangeal joint axis 43 in the forefoot 38 area. In the compliance bending zone 37, a plateau 42 is not surrounded or limited in movement by a perimeter support 44. The perimeter support 44 substantially surrounds the front of the forefoot 38 and other areas of the forefoot 38, but not the compliance bending zone 37. A cross-section of the rearfoot 32 profile is shown in FIG. 13*c*, which is comprised of two sections: a top rigid support section 39 forming a built in stiffener element 34 that ensures a flat, fully supported surface to distribute pressure in the rearfoot 32. The lower section 40 is a spring design to give elastic compliance for comfort and feel in the rearfoot. Both sections of the rearfoot were optimized, through finite element modeling, with composite materials selection and geometry to ensure maximum spring was achieved within the available volume.

Figure 25:
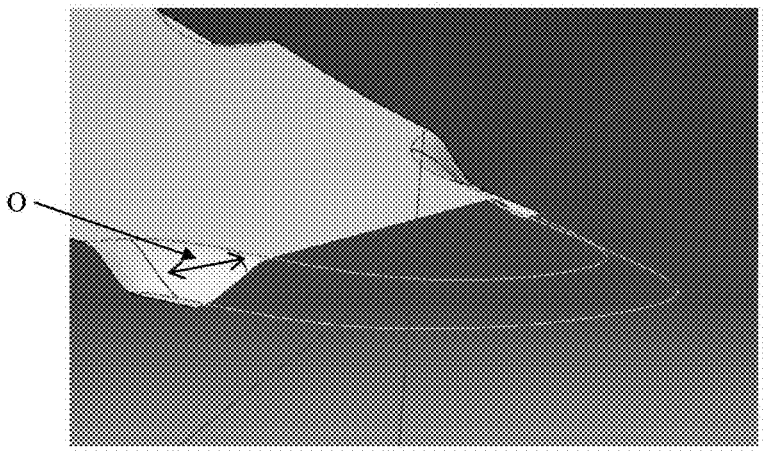
FIG. 25 is a graphical illustration of the ESRO forefoot showing the perimeter offset.
Figure 26:
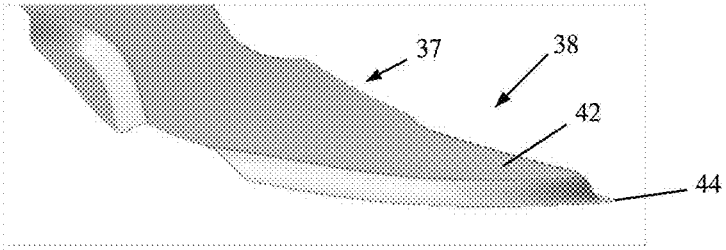
FIG. 26 is a graphical illustration of the ESRO forefoot with a shorter perimeter offset.
Figure 27:
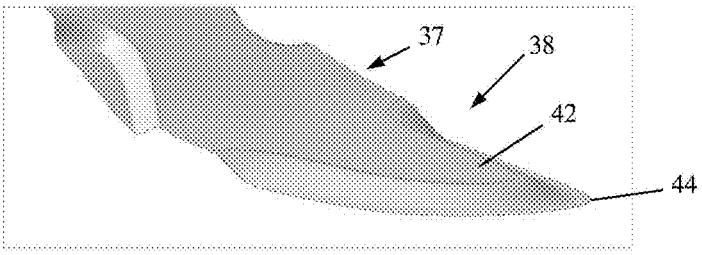
FIG. 27 is a graphical illustration of the ESRO forefoot with a longer perimeter offset.
Figure 28:
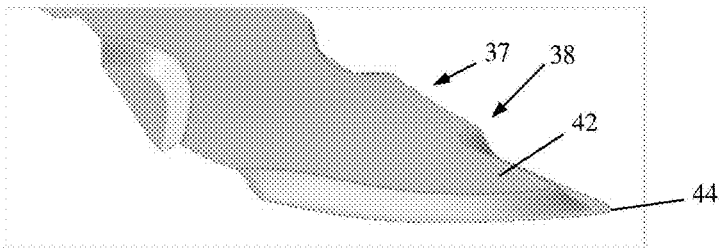
FIG. 28 is a graphical illustration of the ESRO forefoot with an intermediate distance perimeter offset.

The perimeter support 44 is offset from a front edge of the plateau 42 by a perimeter offset O distance, as shown in FIG. 25. Depending on the size of the perimeter offset O from the front edge of the plateau 42 to the front edge of the perimeter support 44, the transition from the plateau to the perimeter support may have either a steep or higher slope (where the perimeter offset is shorter, for example 0.65 inches as in FIG. 26), or a lower slope (where the perimeter offset is longer, for example 0.8 inches as in FIG. 27). With an intermediate perimeter offset of approximately 0.65 inches, as shown in FIG. 28, the position of the plateau and forefoot spring element provides optimal energy return within the desired displacement volume available for the initial conditions used in the FEM.

Figure 14A:
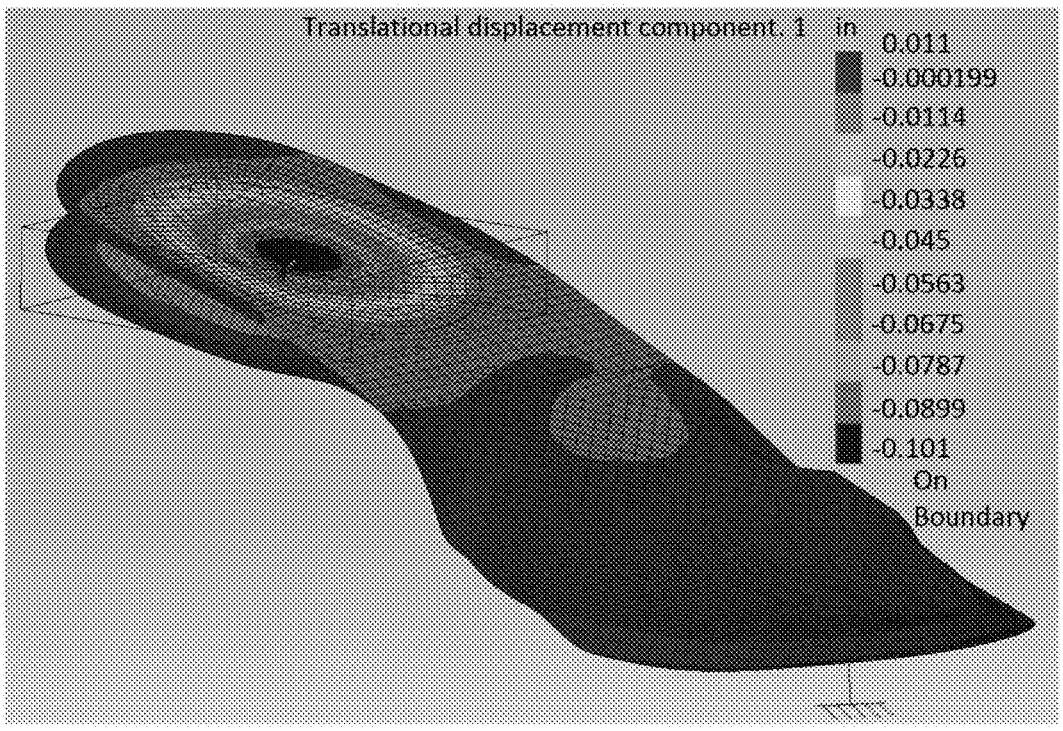
FIGS. 14*a* to 14*d* are graphic illustrations of the results of the finite element modeling of the ESRO, where FIG. 14*a* specifically illustrates the graphical computer simulation results where the rearfoot of the ESRO is under deflection stress.

In this phase of the finite element analysis, the ESRO was comprised of a quasi 0/90/45/−45 carbon 0.005 mil/ply available from Cytec (formally Umeco Composites) as VTM 264 prepreg resin materials, with uniform ply construction. Two loading conditions were initially modeled: 1) compression loading at the rearfoot location to see resulting deflection, and 2) a simple bending load case to calculate the effective forefoot stiffness response. These analyses identified areas of weakness or potential failure of the structure. The stiffness value, or the measure of stiffness, is the maximum force over maximum displacement. The ESRO composite was modeled in four zones: the primary structure along the entire length of the foot, the base spring component and the top and bottom surfaces of the rearfoot stiffener 34 component. FIGS. 14*a-d* shows the results of this structure under the two primary load cases, namely rearfoot compression and full bending during gait motion. The results are:

1. Rearfoot deflection—result showing 0.1" compression under a uniform distributed loading of 100 lbs. over the rearfoot stiffener component (FIG. 14*a*).

Figure 14B:
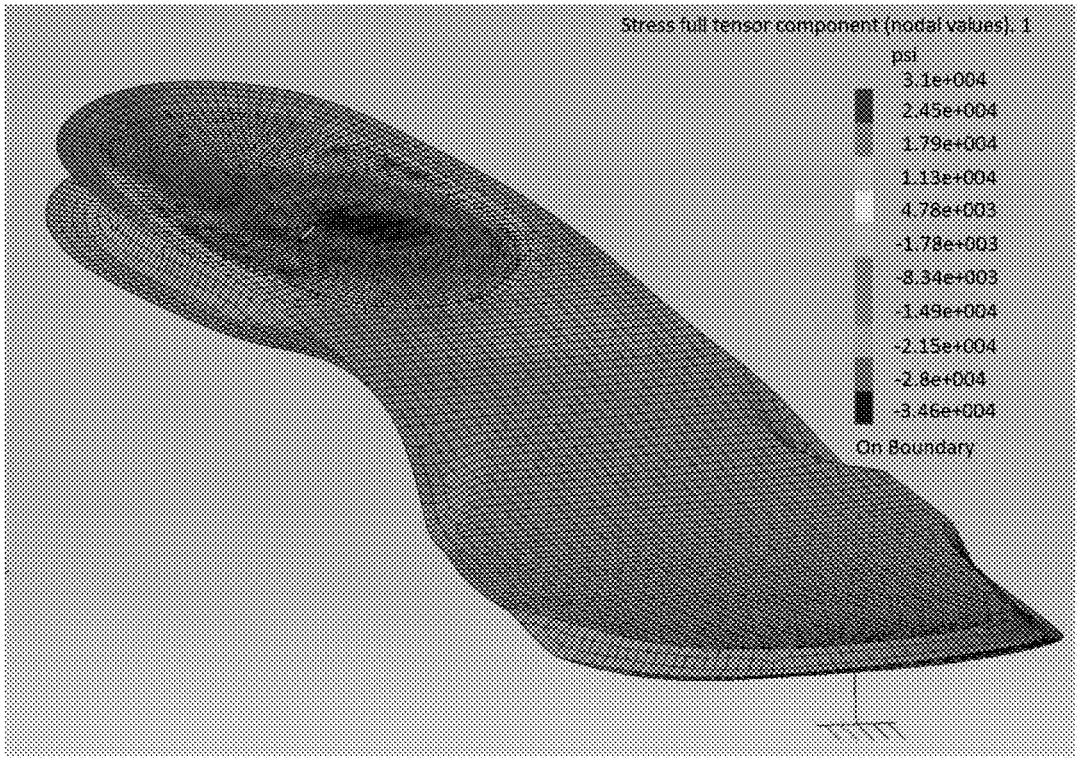

2. Composite rearfoot stresses under constant pressure (FIG. 14*b*).

Figure 14C:
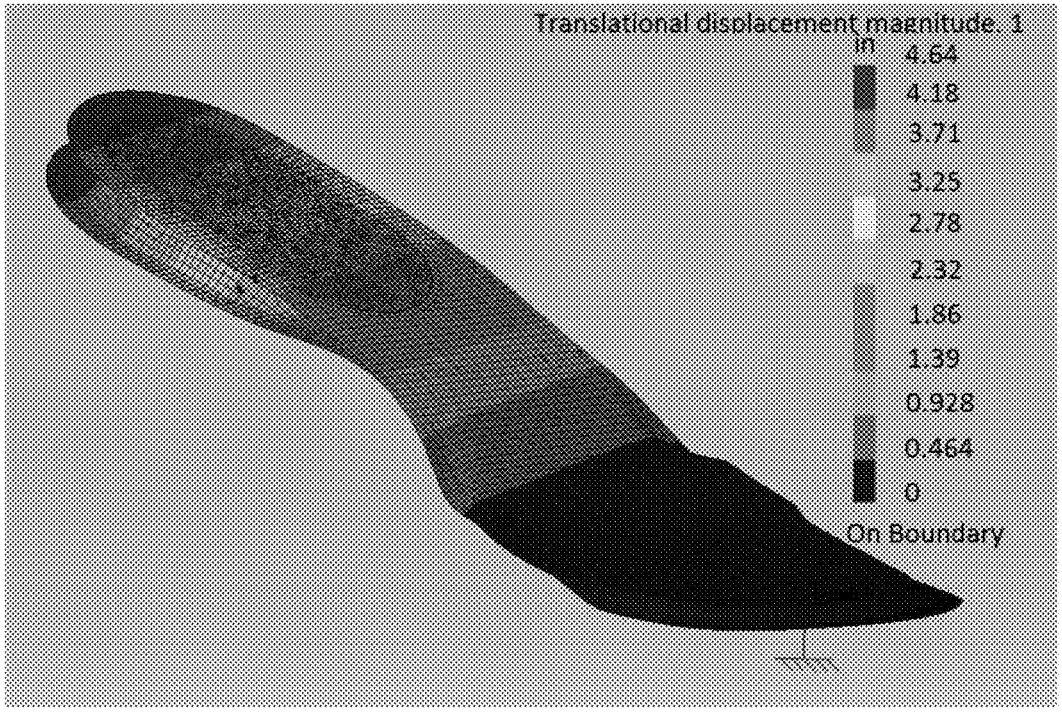

3. Composite forefoot lift with 2 lbs. rearfoot force-2 lbs. of force was placed in the rearfoot area resulting in a peak deflection of 4 inches (FIG. 14*c*).

Figure 14D:
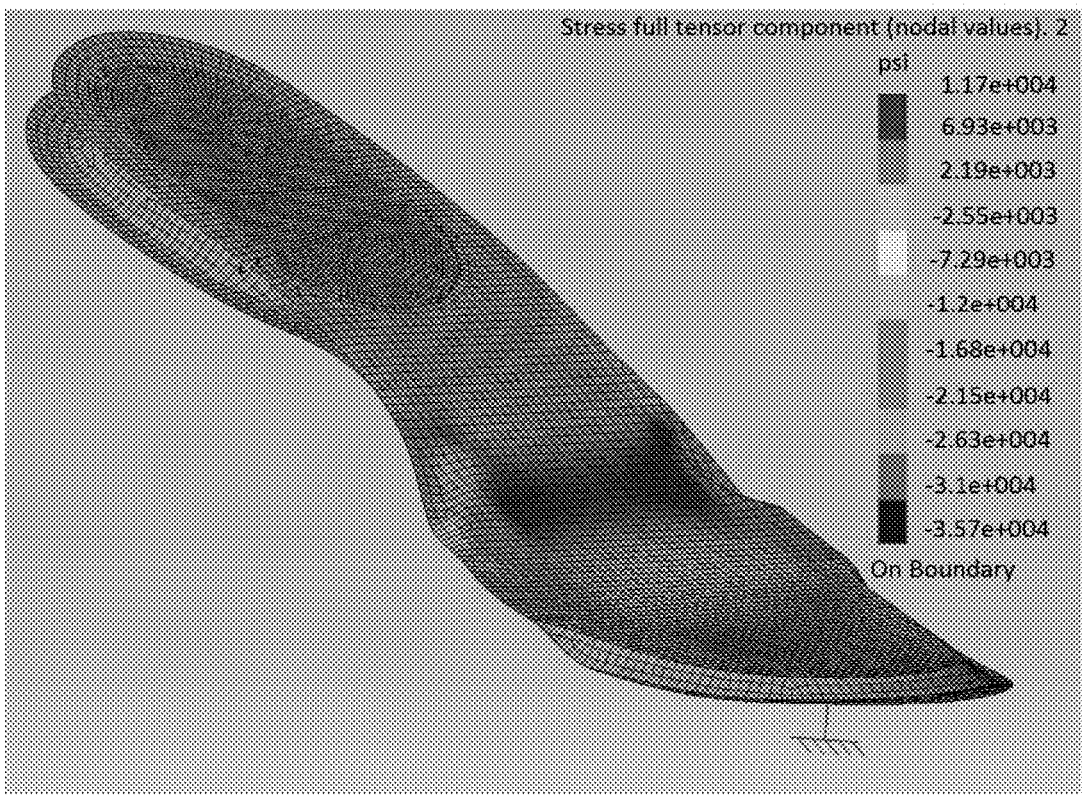

4. Stresses in the 1st (0) ply based on this result (FIG. 14*d*).

These results show the composite ESRO model and can be used to establish the optimal laminate material, lay up and ply drops to minimize weight and maximize energy return without failure to the laminate. The areas of focus in this optimization were regions of maximum strain: the rearfoot spring 40 and compliance bending zone 37. Laminate configurations were selected to ensure ply strains did not exceed maximum allowable values under peak loading conditions. For the rearfoot spring 40, composite materials such as VTM 264 prepreg resin and glass (such as Cycom 7668) laminates were evaluated to optimize deformation verses load as a function of mass and corresponding g loads. It should be understood that the composite material, or composite, from which the ESRO is formed may be a carbon fiber material, a fiber glass material, or appropriate laminates or other combinations of comparable materials.

The representation of the ESRO as a finite element model quantitatively, as in FIGS. 14*a* to 14*d*, demonstrates the energy return of the device and allows modification of the design in an iterative manner. The advantage of modeling over human experimentation is that energy return can be rapidly estimated to optimize product performance. This method allows for optimization of each component of the orthosis—particularly in the forefoot where the benefits of energy return are likely to be considerable. Once the design is optimized to maximize energy return from the orthosis, human experimentation confirms the model predictions and adds the important dimension of subject comfort.

To improve the utility of the finite element model, a fundamental computer-aided design (CAD) was carried out to establish the primary and secondary elements used in the ESRO:

Primary elements directly affect function, stiffness, response and feel. These include basic curves and geometry as well as laminate definition.

Secondary elements include minor geometric details used to achieve structural connectivity, smoothness for form and manufacturability as well as visual aesthetics.

The finite element model was modified so that certain key elements of the ESRO are specified and, therefore, can be easily changed to facilitate a parametric approach to ESRO design. Selected design elements are shown in FIG. 15 and include: new Last model bottom profile, maximum available volume of the container 2, rearfoot spring element 40 curves and forefoot metatarsophalangeal joint axis.

Figure 16A:
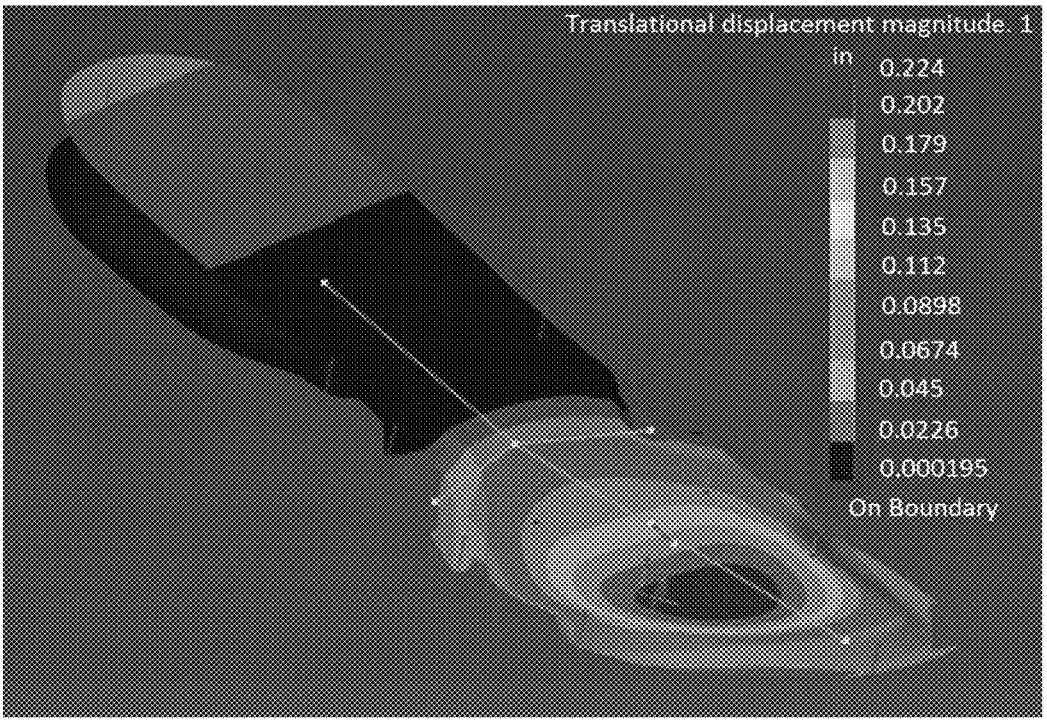
FIGS. 16*a* to 16*c* are graphic illustrations of the ESRO finite element modeling results of the ply thickness considerations for the forefoot section, where FIG. 16*a* specifically shows the computer simulation results of the translational displacement magnitude under stress.
Figures 16B, 16C:
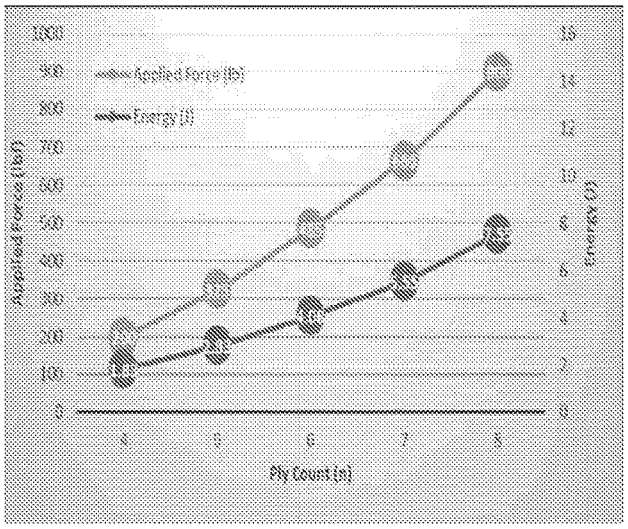

The finite element model (FEM) was employed to determine the maximum allowable force that would maximize use of the available height in the forefoot 38 region (set to 0.24" to prevent bottoming out) at various ply thickness values. The FEM data and results are shown in FIGS. 16*a-c*. Ply count had a significant impact on the applied force required to achieve maximum displacement of the ESRO in the forefoot 38 region. The data also indicates that the greater the applied force for a given ply count, the greater the energy return.

FEM modeling was extended to the rearfoot 32 region of the ESRO to provide a fully parameterized finite element model of the ESRO geometry. The parameter table consists of 12 design inputs that establish the critical features of the ESRO. Table 3 lists the parameters with the corresponding default values:

TABLE 3

| ESRO Design Parameter | Default Value |
|---|---|
| Rearfoot spring ratio | 0.5 |
| Lower rearfoot spring ratio | 0.65 |
| Rearfoot width | 1.1 in |
| Rearfoot plateau width | 0.35 in |
| Rearfoot core width | 0.7 in |
| Rearfoot bottom spring width | 0.15 in |
| Forefoot MTPJ axis angle | 16.1 deg |
| MTPJ plateau | 1 in |
| MTPJ plateau offset to lower back | 0.5 in |
| MTPJ plateau offset to lower front | 0.75 in |
| Forefoot plateau offset | 0.5 in |
| Rearfoot height | 0.6 in |

The impact of ply count on the displacement and total energy observed in an ESRO rearfoot design using the default parameters established in Table 3 for the rearfoot region, was also determined. An applied 200 lb. force was used, and the results are consistent with the observations made for the ply count study in the forefoot. Ply count significantly reduces the amount of displacement and total energy stored for a given force value, as shown in FIG. 17.

The fully parameterized finite element model can also be used to tailor the ESRO design to achieve a particular predetermined desired level of energy storage and return performance based upon a physical characteristic (e.g., body weight) and/or a specific activity (e.g., infantry march, paratrooping or heavy load carriage). Thus, the choice of ESRO characteristics within the new footwear system may be selected based upon a characteristic, such as a predetermined body weight of the wearer. The ESRO may be selected either for a physical characteristic alone, or in combination with a further predetermined activity making use of additional ESRO advantages during paratrooper landings or during heavy load carrying tasks. Likewise, the ESRO may be selected for the predetermined desired activity alone.

Figure 18:
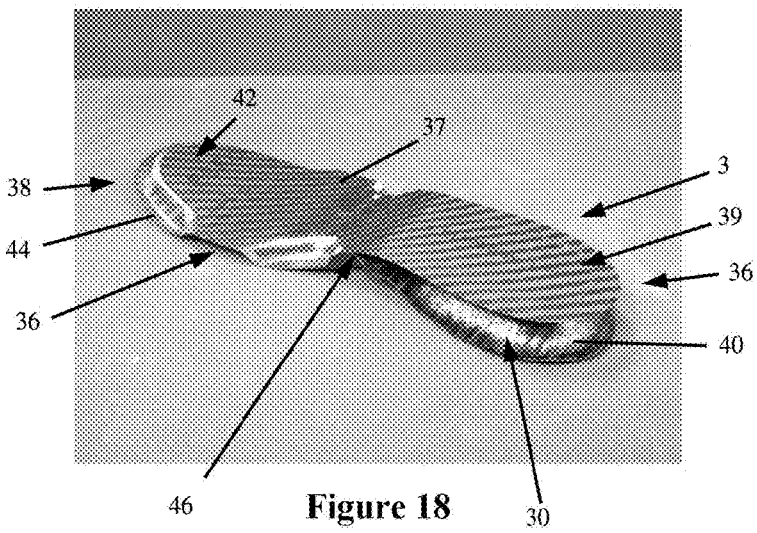
FIG. 18 illustrates a perspective top view of a prototype energy storage and return orthosis tested.

As shown in FIG. 18, the optimized energy storage and return orthosis using the finite element model was fabricated from pre-pregnated carbon fiber laminate, VTM 264, manufactured by Cytec Holdings plc, formerly Umeco plc of Heanor, Derbyshire, UK. The ESRO was tested for impact performance in accordance with the American Society for Testing and Materials (ASTM) F1976 Impact Test. Bench impact tests are used quantify the energy storage and return of footwear. Acceleration (measured in g's) is one measure used to quantify the shock measured during an impact test, where lower acceleration is an improvement and indicates an increase in energy being stored. Energy return is another measure used to quantify footwear performance, where energy return is usually quantified as the percentage of recovered potential energy (which would otherwise normally be converted into heat or Joules) after the impact. Thus, higher energy return percentages in footwear are desirable, since this leads to a reduction in metabolic energy required from the wearer. Impact tests on the new footwear system were conducted on various conditions for comparison, which conditions are detailed in Table 4.

TABLE 4

Experimental conditions for impact testing of the new footbed assembly

| | Experiment 2 | Experiment 4 | Experiment 6 |
|---|---|---|---|
| Outsole | Sierra 1276 from ACB-HW | Sierra 1276 from ACB-HW | Sierra 1276 from ACB-HW |

TABLE 4-continued

| Experimental conditions for impact testing of the new footbed assembly | | | |
|---|---|---|---|
| | Experiment 2 | Experiment 4 | Experiment 6 |
| Midsole | 6 mm injection molded polyurethane (0.58 g/cc density) 6 ply ESRO | 6 mm injection molded polyurethane (0.58 g/cc density) 6 ply ESRO | 6 mm injection molded polyurethane (0.48 g/cc density) 6 ply ESRO |
| Insert | Polyurethane insert from ACB-HW | DIApedia custom ISFO | Polyurethane insert from ACB-HW |

Figure 19A:
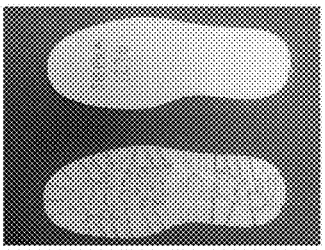
FIG. 19*a* illustrates a bottom view of the outsole of the footbed component parts of the control condition embodiment tested.
Figure 19B:
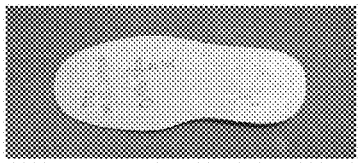
FIG. 19*b* illustrates a bottom view of the midsole of the footbed component parts of the control condition embodiment tested.
Figure 19C:
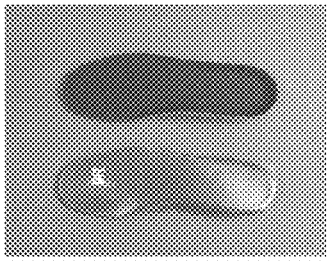
FIG. 19*c* illustrates a bottom view of the standard insert of the control condition embodiment tested.

The control condition of the prior art components compared during testing are shown in FIG. 19, and were detailed as follows:

Outsole: Vibram Sierra 1276 from the Army Combat Boot—Hot Weather (ACB—HW)

Midsole: Injection molded polyurethane (density=0.58 g/cc), 23 mm rearfoot thickness, 11.5 mm forefoot thickness (to simulate the properties of the direct attach midsole of the ACB—HW).

Insert: Fabric covered polyurethane insert from the ACB—HW

The results of the impact tests with respect to each of the experimental conditions in Experiments 2, 4 and 6 showed greater energy return in the forefoot by 57.1%, 51.2% and 53.3%, respectively, as compared to the control condition. In the rearfoot 32, the same conditions showed 28.9%, 31.0% and 23.1% greater energy return compared to the control condition.

Also, peak impact values were collected for each experimental condition and compared to the control condition in both the rearfoot and forefoot regions. Condition Experiment 4 showed the greatest reduction of peak impact force in the rearfoot (12.53 g vs. 13.62 g, 8.0%) and forefoot (12.71 g vs. 20.96 g, 39.4%). Table 5 illustrates these results:

TABLE 5

| Comparison of footbed performance results | | | |
|---|---|---|---|
| | Footbed component source | | |
| | Army Combat Boot Hot Weather | Footwear System condition EXP 4 | % improvement |
| Energy storage | | | |
| Heel (g's) | 13.62 | 12.53 | 8.0% |
| Forefoot (g's) | 20.96 | 12.71 | 39.4% |
| Energy return | | | |
| Heel (%) | 40.2 | 52.67 | 31.0% |
| Forefoot (%) | 35.98 | 54.39 | 51.2% |
| Weight (gm) | | | |
| Outsole | 216 | 216 | |
| Midsole | 233 | 83 | |
| ESRO | | 48 | |
| Insert | 41 | | |
| ISFO | | 51 | |
| Total | 490 | 398 | 18.8% |

Closer analysis of the impact testing data shows that the ISFO effectively reduces the peak impact value in the rearfoot by 16.3% compared to the standard polyurethane insert (Experiment 4 vs. Experiment 2). Also, the use of a lower density (0.48 g/cc) midsole was effective in lowering peak impact values in both the rearfoot (15.4%) and forefoot (11.9%) compared to the standard midsole material (0.58 g/cc) (Experiment 6 vs. Experiment 2).

Each of the experimental conditions has an increased overall thickness, which may also contribute to the reduced impact response and increased energy return compared to the control condition. Therefore, the test data was normalized to eliminate the thickness effect for impact response and energy return in both the forefoot and rearfoot. The results are shown in FIG. 20, where the charts emphasize that, in the forefoot and rearfoot, improvements in both energy return and impact response—independent of the thickness—were achieved. The results are particularly significant in the forefoot.

Figure 21A:
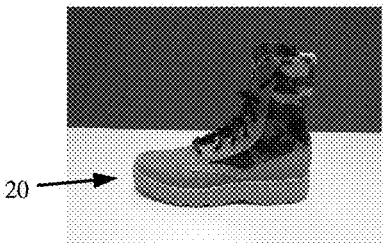
FIG. 21*a* is a lateral view of the new footwear system prototype combat boot.
Figure 21B:
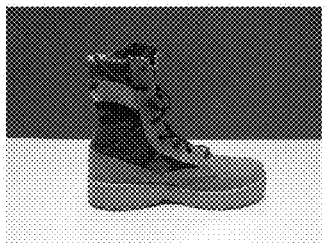
FIG. 21*b* is a medial view of the new footwear system prototype combat boot.
Figure 21C:
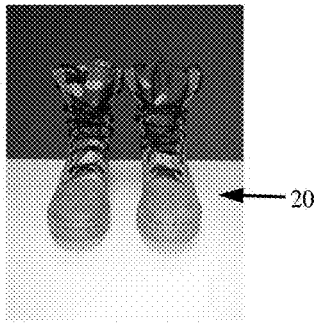
FIG. 21*c* is a front view of a pair of new footwear system prototype combat boots.

The new footwear system, in the form of the prototype combat boot shown in FIGS. 21*a-c* incorporates several advanced features:

The new boot was manufactured using the new Last model design L, shown in FIG. 2, and described herein, which incorporates the described features aimed at improving footwear performance for the active soldier.

Figure 22A:
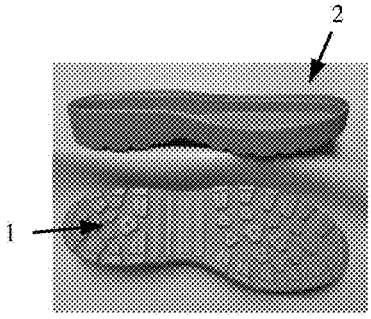
FIG. 22*a* is a side view and a bottom view of the cup sole or container of the new footwear system combat boot.
Figure 22B:
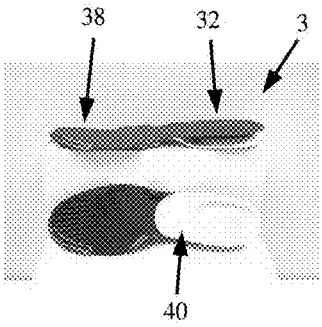
FIG. 22*b* is a side view and a bottom view of the ESRO insert of the new footwear system combat boot.
Figure 22C:
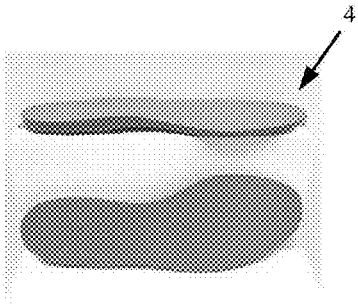
FIG. 22*c* is a side view and a top view of the midsole component of the new footwear system combat boots.

Improved footbed assembly 22 integrating a container 2, which is a cup-like sole having a molded tread pattern, with an energy storage and return orthosis (ESRO) 3 and a molded midsole 4, all as shown in FIG. 22. It should be understood that the footbed assembly may include a one piece container including a desired tread pattern as in FIG. 22, or may include a two piece configuration with a separate outsole and container, as schematically shown in FIG. 1.

The ESRO design uses finite element modeling to optimize design and material combinations for component fabrication.

Significantly, the baseline boot (no insole/insert) of the improved footwear system provides a weight reduction of ≥20% compared to the standard issue Army Combat Boot—Hot Weather model. These factors (increased energy return and reduced weight) will reduce metabolic energy expended by a wearer during locomotion.

In-Shoe Foot Orthosis (ISFO) The modular in-shoe foot orthosis 21 enables a wearer-specific orthosis to be accommodated in necessary or desired cases. For example, the base 5 can be standardized, or can be machined to match the individual foot shape of a wearer to provide customized support. Alternatively, if a soldier presents with a lower extremity overuse injury, the base orthosis shape can be modified to include wearer-specific orthosis interventions designed using the soldier's three-dimensional foot shape and biomechanical function in the form of plantar pressure distribution or profile. The level of ISFO customization can be tailored to the individual or physical activity to optimize comfort and support.

Figure 23:
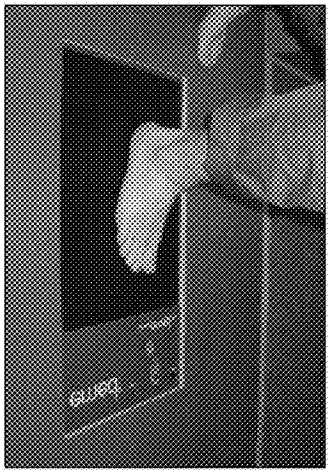
FIG. 23 depicts the system used for plantar pressure data collection.

Orthoses customization is achieved by revising the base component to incorporate individualized orthosis features (e.g., metatarsal pads M and reliefs R). A three dimensional laser scan of a foot was captured from a foam box impression using a NextEngine 3D scanner (NextEngine, Cupertino, Calif.). Barefoot plantar pressure is collected over a series of walking trials on a pressure measurement platform (Novel GmbH, Munich, Germany), which has a matrix of 48×79 pressure sensors at a density of four sensors per $cm^2$ (FIG. 23). The base component of an ISFO is customized by overlaying and aligning the foot shape data and pressure distribution. Patient-specific pressure data is uploaded to the DIApedia's TrueContour® Insole Design Software ("IDS"), as illustrated in FIG. 24*a*, showing data averaged over the walking trials and displayed as average maximum peak pressure in the form of contour lines. The plantar pressure contours are overlaid and aligned on the customized base orthosis surface, shown in FIG. 24*b*. After alignment is complete, a specific pressure contour line is selected to form the leading edge of a pressure reducing metatarsal pad, shown in FIGS. 24*c* and 24*d*. Once the geometry of the metatarsal pad is defined, the pad surface is generated and blended with customized base orthosis surface and the combined surface data is exported to the milling machine software, as in FIG. 24*e*, ready for manufacture by milling machine hardware. The DIApedia method is described in U.S. Pat. No. 7,206,718.

Another important consideration in the design of novel footwear components is the selection of materials used for component manufacture. Certain materials, while having superior physical performance characteristics, may not be easily fabricated for functional use in a boot. Table 6 provides a partial summary of the range of materials and advanced composites used to improve function for specific footwear system components:

TABLE 6

Materials for construction of footwear components

| Component | Material |
|---|---|
| Container/outsole | Neoprene, rubber |
| Energy storage/return orthosis | Carbon and glass fiber, Kevlar, and combinations |
| Midsole | Lightweight EVA foam, polyether polyurethane foam |
| Modular in-shoe foot orthosis | |
| Base | Polypropylene, carbon fiber, EVA foam |
| Top cover | Polyethylene and polyurethane foams, and combinations |
| Toe cap | Carbon fiber, Kevlar |

The process for fabricating the ESRO employs unidirectional fiber reinforced epoxy layers that are laminated into net-shape. The thickness of the laminate may vary throughout the part by varying the number of layers (0.006-0.01 inch thick each) to satisfy device requirements of comfort, maximum specific energy storage (energy/weight) and puncture protection while fitting into the available space. The laminate stacking sequence (ply orientation) is chosen to provide optimal bending and torsional stiffness.

The advanced composite materials used in the construction of the ESRO not only provide the mechanical properties to enable a reduction in energy consumption but also exhibit excellent resistance to puncture and stab threats through the use of an additional Kevlar® fiber protection layer inserted between the ESRO and outsole. A foam layer inserted between the ESRO and Kevlar layer provides backing support that reduces concentrated deformation of this protection layer. The Kevlar layer and backing foam material is optimized to maximize stab protection by controlling the magnitude of local shear deformation at the impact location.

In a preferred embodiment, a variable temperature molding carbon fiber resin composite (Umeco VTM 264) is used in the fabrication of the ESRO. This material was selected for its mechanical properties (light weight, tensile and compression strength) and low temperature processing conditions. The use of multiple plies with changing fiber orientation allows for tailored functionality (e.g., higher compression in rearfoot, greater torsional stiffness in forefoot).

To manufacture the ESRO, the ESRO was split into two components which were molded as separate parts: a top single piece that traverses the full foot length, and the rearfoot spring element 40 which was subsequently bonded to the top section. FIG. 18 illustrates the bottom view of the ERSO as hollow. However, this lower section 30 of the spring element could be filled with any desired material. The bonding locations 46 for adhering the components are shown in FIG. 13*c*. Both mold parts were shaped with an extended surface to allow for application of vacuum on the pre-impregnated composite laminate during processing and cure. Mold designs were finalized and converted to an appropriate file format for CNC machining.

To manufacture the energy storage/return orthosis (ESRO):

(1) The machined molds were finished and a wax release coating was applied to allow for release of the composite part.

(2) VTM 264 Prepreg was removed from freezer and allowed to come to near room temperature and was cut to approximate shape with an extension of approximately 1.5" beyond the outer mold line.

(3) [45/−45] Prepreg ply was placed on the main mold followed by the core at the rearfoot location followed by the [0/90] ply.

(4) [45/−45] Prepreg ply was placed on the smaller mold followed by the [0/90] ply.

(5) Breather ply followed by vacuum bagging was applied to both molds with house vacuum (~14.4 psi) applied.

(6) Parts were placed in oven and heated under vacuum to 90° C. for 5 hours.

(7) Parts were removed from the oven and allowed to cool.

(8) Parts were removed from the tooling and cleaned.

(9) M-bond adhesive was used to bond both parts together and allowed to cure overnight.

(10) Parts were trimmed to achieve final net-shape to ensure fit within the outsole container volume.

While the preferred embodiments of the invention have been illustrated and described, it should be understood that variations will become apparent to those skilled in the art. Accordingly, the device and methods are not limited to the specific embodiments illustrated and described herein, but rather the true scope and spirit of the invention are to be determined by reference to the appended claims.

We claim:

1. A composite material energy storage and return orthosis for a footwear system, the orthosis comprises first and second components with the first component including a forefoot section and a rearfoot section, the forefoot section having a perimeter support and a plateau which is offset horizontally and vertically from the perimeter support, and where each forefoot and rearfoot section includes a spring element and the spring element of the first component rearfoot section includes the second component having a hollow area filled with air and directed away from a top support of the first component rearfoot section, and the second component is secured to the first component to form the orthosis.

2. The orthosis of claim 1, wherein the forefoot section includes a compliance bending zone, and the forefoot section is bendable across a plateau along a metatarsophalangeal joint axis of the forefoot section within the compliance bending zone.

3. The orthosis of claim 2, wherein the plateau of the forefoot section includes a front edge positioned relative to the perimeter support by a plateau offset having a slope selected to enable optimal energy return during use of the orthosis.

4. The orthosis of claim 1, comprises composite material of a pre-pregnated carbon fiber laminate of at least 2 ply.

5. The orthosis of claim 4, wherein movement of the first component in the compliance bending zone of the forefoot section provides an energy return performance which is at least 50%.

6. The orthosis of claim 4, wherein the rearfoot section is adapted to provide a peak impact response of less than 13 g-acceleration.

7. The orthosis of claim 4, wherein the forefoot section and the rearfoot section are adapted to provide an increased energy return without compromising peak impact response.

8. The orthosis of claim 1, wherein the top support has a stiffness value greater than a stiffness value of the second component.

* * * * *